US005398345A

United States Patent [19]

Kenneth et al.

[11] Patent Number: 5,398,345

[45] Date of Patent: Mar. 21, 1995

[54] COMBINATION APERTURED GARMENT POCKET AND OBJECT

[76] Inventors: Howard Kenneth, 1002 Castilian Ct. #B-303, Glenview, Ill. 60025; George R. Stoker, Jr., 4555 N. Malden Ave., Chicago, Ill. 60640

[21] Appl. No.: 57,505

[22] Filed: May 5, 1993

Related U.S. Application Data

[62] Division of Ser. No. 800,274, Nov. 29, 1991, Pat. No. 5,210,881.

[51] Int. Cl.[6] ..... A41D 27/08

[52] U.S. Cl. ..... 2/247; 2/75; 2/115; 2/244; 446/28

[58] Field of Search ..... 2/69, 69.5, 49.1, 49.2, 2/49.3, 49.4, 49.5, 75, 80, 83, 105, 106, 115, 247, 248, 249, 250, 251, 252; 446/26, 27, 28; D2/741, 841, 844

[56] References Cited

U.S. PATENT DOCUMENTS

| | | | |
|---|---|---|---|
| 1,701,152 | 2/1929 | Freedman | D2/863 |
| 2,593,218 | 4/1952 | Swain | 2/48 |
| 2,628,452 | 2/1953 | Gladstein | 446/28 |
| 2,686,313 | 8/1954 | Seidler | 2/75 |
| 4,138,745 | 2/1979 | Greenspan | 2/247 |
| 4,874,340 | 10/1989 | Smallwood | 446/28 |
| 5,204,995 | 4/1993 | Knapp | 2/247 X |
| 5,210,881 | 5/1993 | Stocker, Jr. et al. | 2/115 X |

FOREIGN PATENT DOCUMENTS

| | | | |
|---|---|---|---|
| 8802605 | 4/1988 | WIPO | 446/28 |

*Primary Examiner*—Jeanette E. Chapman
*Attorney, Agent, or Firm*—Martin Faier

[57] ABSTRACT

A combination apertured garment pocket and object adapted for securement in the pocket, where the pocket is attached to the garment by seams and has apertures therein, and the object, which may be a teddy bear, having appendages, is adapted to be removably secured in the pocket so that the appendages extend outside of the pocket through the apertures and are visible when positioned in said pocket, the apertures being arranged through the pocket panel spaced apart from the seams. The garment may have two dimensional graphic indicia arranged on it and the three dimensional object, when secured in the pocket, forms a part of the graphic indicia.

12 Claims, 1 Drawing Sheet

COMBINATION APERTURED GARMENT POCKET AND OBJECT

This application is a continuation in part of application Ser. No. 07/800,274, filed Nov. 29, 1991, now U.S. Pat. No. 5,210,811, for a Combination Garment Pocket and Object.

BACKGROUND AND SUMMARY OF THE INVENTION

This invention relates to a combination apertured garment pocket and object and is more particularly directed to such an assemblage for use by or with a child or other person which provides a novel display and carrying means for an object, such as a toy like a stuffed animal or doll, or other item, having an appendage, such as arms or legs extending therefrom.

Most young children have a favorite doll, toy or teddy bear, and frequently, to the chagrin of a loving adult, the doll, toy or teddy bear is misplaced and lost or the child may lose interest in it. The present invention consists of a novel apertured pocket arrangement for a garment combined with such an object like a doll, toy or teddy bear having an appendage or appendages which may be held and displayed in the pocket in a surprising way particularly useful to entertain a child and hold the child's interest, while having the object available to the child.

A typical garment embodying the invention may consist of a Tee shirt or other garment which has secured on it a special apertured pocket, sewn conventionally to the garment, but having arranged in it apertures for receiving and removably holding the object, while keeping the object visible and accessible to the child.

The object in the pocket may also form a three dimensional part of an overall design in combination with a graphic display arranged on the garment and pocket. For example, the garment and pocket may have a scene printed on it and the three dimensional object is a teddy bear which fits into the pocket and form part of the illustration, the display may appear as a Jungle scene which shows a tree branch printed on the garment and a teddy bear nest in the tree branch.

Preferably, the object is a toy, doll or teddy bear, which must be of a size and shape to be removably secured in the pocket apertures. The shirt may and the pocket should be formed of a knit stretch fabric, and the object should be relatively soft, to permit it to be slightly compressed to enter the apertures and be held in the pocket.

OBJECT AND ADVANTAGES OF THE INVENTION

It is the object of the present invention to provide a combination apertured garment pocket and object removably secured therein of the character recited.

Another object is to provide an apertured garment pocket which is constructed to removably secure therein an object such as a toy having appendages extending therefrom visible in the pocket.

Another object is to provide an object removably secured in an aperture in a garment pocket which forms a part of a graphic design applied to the garment.

Another object is to provide a compressible object having an appendage and made of compressible material adapted for easy insertion into and removal from one or more apertures in a garment pocket fabricated from stretchable material.

It is the further object of the invention to provide such a combination apertured garment pocket and object which is easy, efficient, entertaining, relatively inexpensive and simple to construct and use.

These and other objects and advantages will become more apparent as this description proceed, taken in conjunction with the accompanying drawing.

DESCRIPTION OF PREFERRED EMBODIMENTS

Figure 1:
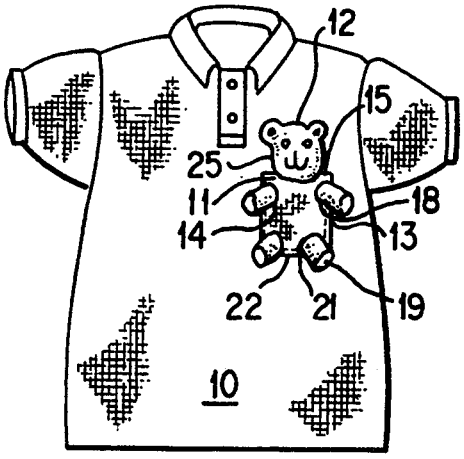
FIG. 1 is a plan view of a garment having an apertured pocket and an appendaged object removably secured therein embodying the present invention.
Figure 2:
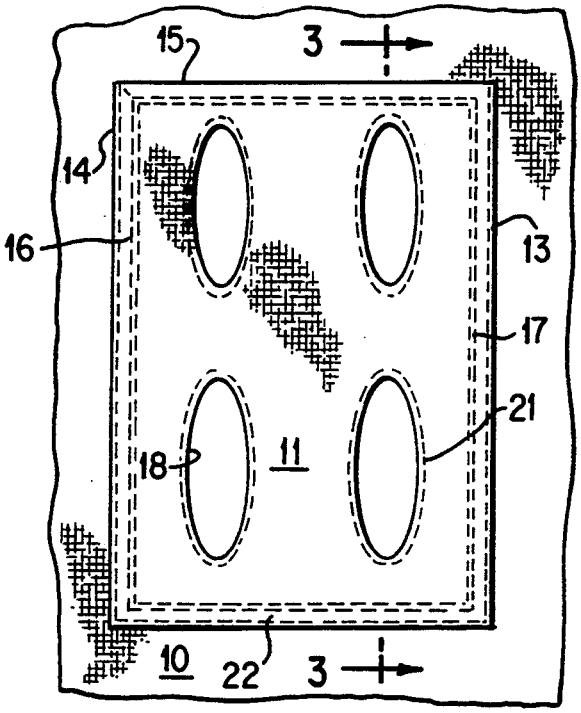
FIG. 2 is a an enlarged plan view of an apertured pocket for use in the present invention.
Figure 3:
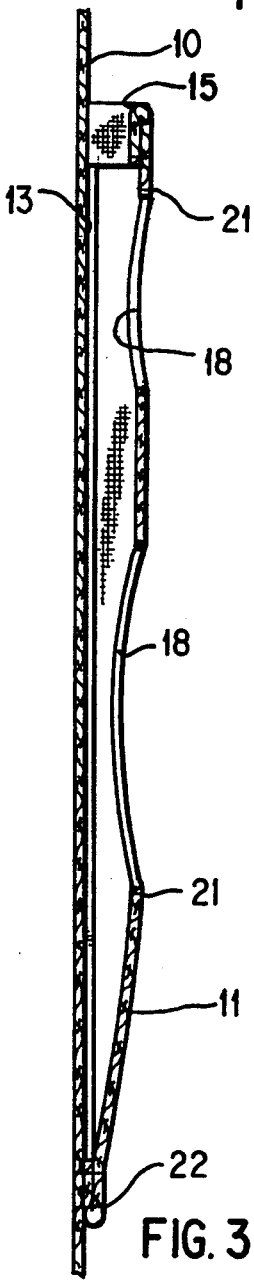
FIG. 3 is a sectional view of the apertured pocket shown in FIG. 2, taken on line 3—3 thereof.

With reference to the accompany drawings, a Tee shirt 10 or other garment has secured to it a pocket 11, which contains an object like a toy 12, such as a teddy bear or the like. Preferably, this pocket 11 is constructed of yieldable fabric and the object 12 is compressible, like a stuffed animal, so that the toy may be compressed and the pocket may be stretched during entry of the toy and removal of the toy from the pocket, but the toy and the pocket will resume their natural condition when the toy is removed from the pocket.

Preferably, this pocket 11 is constructed with an open top seam 15, opposed side seams 13 and 14, reinforcing seams 16 and 17, and closed bottom seam 22, the closed seams 13, 14, 16, 17 and 22 preferably being sewn through the pocket and underlying shirt to securely join the pocket 11 to the shirt 10. Arranged in the face of and through the pocket 11 are arcuate apertures 18, arranged to permit the appendages 19 of the toy 12 to fit through the apertures and be held there, thus allowing a part of the toy 12 to be visible in the pocket 11, while holding it securely in the apertures 18. Preferably a part of the toy 12, such as the teddy bears's head, extends above the pocket through the top seam 15, as shown. To prevent tearing of the pocket, the apertures 18 preferably are surrounded by a seam 21 through the pocket.

Figure 4:
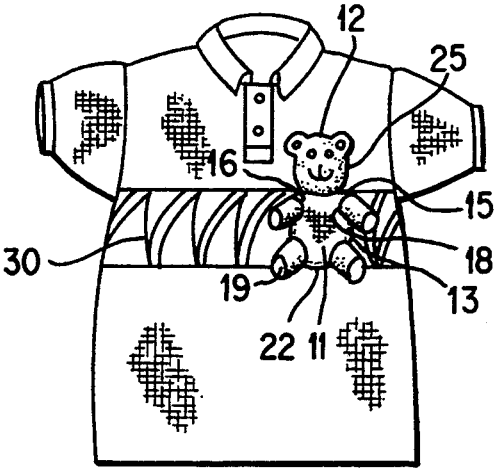
FIG. 4 is a plan view similar to FIG. 1, except showing an embodiment where a graphic design forms a part of the invention.

As shown in the FIG. 4 embodiment, the garment 10 may be given a three dimensional appearance by applying a two dimensional design 30 in the vicinity of the pocket 11, and this design may have worked into it the display of the three dimensional toy 12 secured in the pocket 11. For example, the two dimensional design 30 may consist of a tree branch printed on the garment 10 where the toy is positioned in the pocket, to make it appear that the toy, which may be a koala bear is nested on the tree branch; or the design 30 may be of a fanciful highway and the toy may appear like a toy automobile which can be removed from or placed upon the highway design. In any event, this design 30 may be of any configuration, flat or dimensional, the important consideration being that the three dimensional toy 12 forms a part of the design 30 by its positioning in the pocket 12, and when removed changes the visual impression of the garment 10.

It has been found that an arrangement of the kind described in this application holds the interest of and fascinates small children. The child is surprised by the appearance of the toy in the pocket on the garment and usually wants to be a part of the circumstances of wearing the toy. There is also a "hide and seek" game-like aspect of the arrangement which captivates the child. Not only in the child entertained, but the manipulation of the toy into and from the pocket helps the child's leaning of manual dexterity and the association of the toy and garment pocket teaches the child an intended relationship between them, making such a combination please entertaining, useful and educational for small children. The present arrangement of the apertures holding the appendages of the object provides means for usually keeping the object with the garment and not lost, making this invention useful for childrens and adults garments.

While preferred embodiments of the invention have been shown and described in considerable detail, it is not intended that the invention should be limited to the exact construction disclosed, as many variations in the structure can be made without departing from the spirit or scope of the invention.

Accordingly, we claim:

1. A combination apertured garment pocket and object adapted for removable securement in said pocket, said pocket comprising a panel having at least one apertured element therein, and an object removably secured in said pocket, said object having appendages, portions of which are adapted to extend outside of said pocket through said apertured element, said portions of said object being visible when said object is positioned in said pocket, seams through said pocket and garment for securing said pocket to said garment, one side of said pocket being free of seams, said apertured element being arranged through said pocket spaced apart from said seams and comprising an opening adapted to permit said appendages portions to fit through and be held in said opening, and reinforcing stitches through said pocket surrounding said apertured element adapted to prevent tearing of said pocket wherein said object appendages portions are arranged horizontally and vertically aligned in pairs, and said at least one apertured element comprises a plurality of like apertured elements arranged in horizontal and vertical aligned pairs to accommodate the appendages of said object.

2. The combination apertured garment pocket and object recited in claim 1, wherein aid pocket panel is fabricated from yieldable fabric.

3. The combination apertured garment pocket and object recited in claim 1, wherein said pocket panel is stretchable away from the plane of the underlying garment when said object is secured in said pocket.

4. The combination apertured garment pocket and object recited in claim 1, wherein said object is fabricated from compressible material.

5. The combination apertured garment pocket and object recited in claim 4, wherein said object is resilient and returns to normal configuration when secured in said pocket through said apertured element.

6. The combination apertured garment pocket and object recited in claim 1, Wherein said seams comprise stitching through said pocket and garment along the sides and bottom of said pocket.

7. The combination apertured garment pocket and object recited in claim 1, wherein said garment has graphic indicia decorating it adjacent to said pocket and said object when secured in said pocket forms a part of said graphic indicia.

8. The combination apertured garment pocket and object recited in claim 7, wherein said graphic indicia is two dimensional and said object when secured in said pocket is three dimensional.

9. The combination apertured garment pocket and object recited in claim 1, wherein said object appendage portions are disposed in a plane transverse to said pocket panel as to removably secure said object in said when said garment is moved.

10. The combination apertured garment pocket and object recited in claim 9, wherein said object appendage portions may be manipulated into the plane of said pocket panel to insert said object into and remove said object from said pocket.

11. The combination apertured garment pocket and object receited in claim 1, wherein said apertured element is formed by removing material from said pocket.

12. The combination apertured garment pocket and object recited in claim 11, wherein said apertured element is arcuately shaped.

* * * * *